US006976338B2

(12) United States Patent
Olk et al.

(10) Patent No.: US 6,976,338 B2
(45) Date of Patent: Dec. 20, 2005

(54) WATER DIVERTER

(75) Inventors: Justin S. Olk, Kent City, MI (US); Geary L. Olk, Kent City, MI (US)

(73) Assignee: Advanced Home Improvement Co., Inc., Kent City, MI (US)

( * ) Notice: Subject to any disclaimer, the term of this patent is extended or adjusted under 35 U.S.C. 154(b) by 69 days.

(21) Appl. No.: 10/439,806

(22) Filed: May 16, 2003

(65) Prior Publication Data

US 2004/0226225 A1 Nov. 18, 2004

(51) Int. Cl.[7] ..... E06B 7/14
(52) U.S. Cl. ..... 52/97; 52/209
(58) Field of Search ..... 52/97, 209, 58, 52/60, 61, 62, 408

(56) References Cited

U.S. PATENT DOCUMENTS

| | | | | |
|---|---|---|---|---|
| 4,672,784 | A * | 6/1987 | Pohlar | 52/235 |
| 5,123,212 | A * | 6/1992 | Dallaire et al. | 52/209 |
| 5,303,522 | A | 4/1994 | Vagedes | 52/97 |
| 5,307,597 | A * | 5/1994 | Tanikawa et al. | 52/97 |
| 5,516,232 | A * | 5/1996 | Filipski | 405/36 |
| 5,581,970 | A | 12/1996 | O'Shea | 52/718.01 |
| 5,586,415 | A | 12/1996 | Fisher et al. | 52/58 |
| 5,822,933 | A | 10/1998 | Burroughs et al. | 52/209 |
| 5,921,038 | A | 7/1999 | Burroughs et al. | 52/209 |
| 6,076,310 | A | 6/2000 | Kim | 52/97 |
| 6,119,416 | A | 9/2000 | Larson | 52/212 |
| 6,161,344 | A | 12/2000 | Blanchett | 52/97 |
| 6,170,207 | B1 * | 1/2001 | Saindon | 52/204.2 |
| 6,385,925 | B1 | 5/2002 | Wark | 52/209 |
| 6,481,164 | B1 | 11/2002 | McCorkel | 52/58 |
| 6,490,835 | B1 * | 12/2002 | Simmons | 52/554 |
| 6,619,004 | B2 * | 9/2003 | Loper | 52/302.1 |

* cited by examiner

*Primary Examiner*—Ramon O. Ramirez
*Assistant Examiner*—Steven Marsh
(74) *Attorney, Agent, or Firm*—Warner Norcross & Judd LLP

(57) ABSTRACT

A water diverter that diverts water flow from under siding or external fascia on a building to the environment in regions adjacent a portal, such as a window, door or vent. The water diverter includes a first wall, a base joined with the first wall, and an outer wall joined with the base. In an upper portion the first wall, base and outer wall form a collector that collects water flowing along a building wall or the portal structure. In a lower region, the first wall, base and outer wall cooperate to define the channel. The base may be angled or curved outwardly from the building wall to divert water away from the building wall and into the channel. Preferably, the upper portion is disposed under siding, and the lower portion is disposed on the exterior of the siding so that water travels from under the siding to the environment, downwardly along the portal structure.

21 Claims, 10 Drawing Sheets

WATER DIVERTER

BACKGROUND OF THE INVENTION

The present invention is directed to a water diverter that diverts water away from a building substructure in areas near portals, such as windows, doors, vents and the like.

Many buildings are clad on the exterior with siding to protect the building substructure from the environment and add aesthetic appeal to the building. In practice, multiple siding panels are locked together to cover a building substructure, such as a wall. Where portal structures, for example, windows, doors, vents and the like are included in a wall, the siding panels are cut to custom fit around the portal structures. However, no matter how precisely the siding panel is cut around the bottom of the portal structure, water from rain and the like, inevitably flows down along the vertical edges of the portal structure, between the bottom of the portal structure and the cut siding panel, and behind the siding. Accordingly, water damage to the building substructure near or below the bottom of the portal structure occurs. If a significant amount of water leaks around the portal structures, the adjacent substructure may decay or water may leak directly into the building. Furthermore, in colder climates, water may accumulate behind the siding and freeze, thereby causing it to separate from the building wall.

In an attempt to prevent water from leaking under siding, siding installers apply caulk in the gap defined between the bottom of the portal structure and the siding panel. The caulk seals the gap to prevent water leakage. However, caulk deteriorates or tears due to the contraction and expansion of the siding with temperature change. Thus, many times caulk does not eliminate water leaks around portal structures.

Another attempt to solve water leakage around portal structures is disclosed in U.S. Pat. No. 6,076,310 to Kim. Kim shows a device including an upper portion having perpendicular left and right side surfaces that fit in a corner of a window frame. In a lower portion of the device, the two surfaces are curved and tapered to form a deflecting portion that deflects water outwardly, away from the window frame. Although the device in Kim diverts some water, it suffers several shortcomings. First, the upper portion of the Kim device may act as a dam, deflecting water back, behind the siding adjacent the device. Second, if not positioned properly relative to the siding and the window, the lower portion also may deflect water outwardly, but directly under the siding adjacent the bottom of the window frame.

SUMMARY OF THE INVENTION

The aforementioned problems are overcome in the present invention which provides a water diverter including a collector, which collects water flowing under siding and/or adjacent a portal structure, and a channel, which conveys the water downwardly along a portal structure and into the environment.

In one embodiment, the water diverter includes an inner wall, a base projecting outwardly from the inner wall, and an outer wall projecting from the base and aligned with the inner wall. The inner wall, base and outer wall cooperate to define a collector in an upper portion of the device that collects water flowing behind the siding and/or adjacent a portal structure, and a channel in a lower portion that channels water downwardly along the portal structure.

In a more specific embodiment, the base is ramped or curved to convey water away from the substructure and/or portal structure and into the channel.

In another aspect of the invention, the water diverter inner wall includes mating features that mate with features on the portal structure. The features are repeated along the portal structure to provide adjustability in positioning the diverter at various locations along the portal structure.

In yet another aspect, the inner wall is formed by a wall of the portal structure, the base extends outwardly from the portal structure wall, and the outer wall extends upwardly from the base. In this aspect, the portal walls, base and outer wall define a collector and a channel in fluid communication with one another.

The present invention provides a water diverter that collects water flowing under siding and/or adjacent a portal structure. The diverter then conveys the collected water away from the building substructure under the force of gravity and downwardly within a channel, along the portal structure. Accordingly, water is prevented from being deflected back under the siding or toward the substructure as with conventional devices.

These and other objects, advantages and features of the invention will be more readily understood and appreciated by reference to the detailed description of the invention and the drawings.

DETAILED DESCRIPTION OF THE INVENTION

I. Overview

Figure 1:
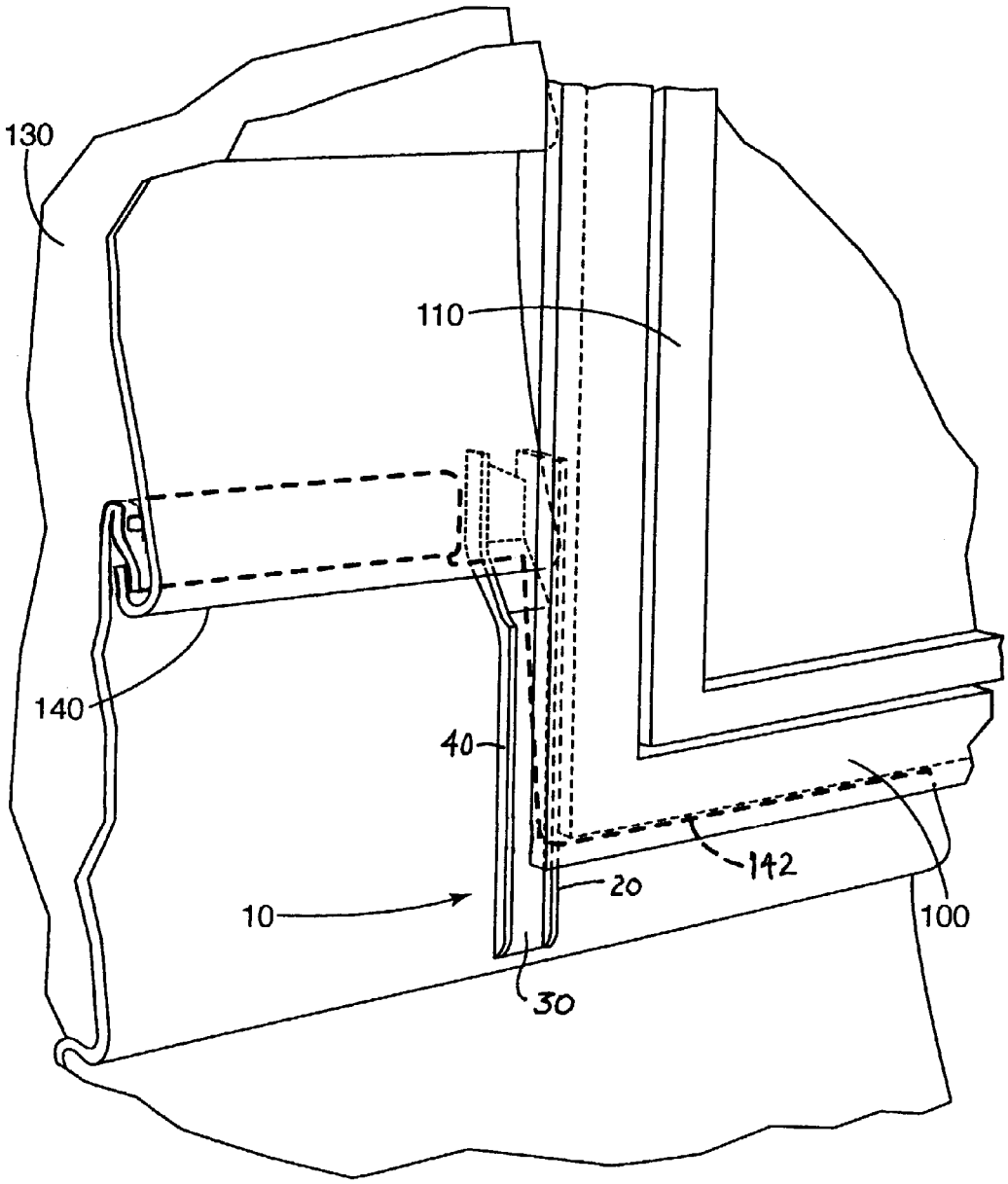
FIG. 1 is a perspective view of a water diverter of the present invention installed adjacent a window frame.
Figure 4:
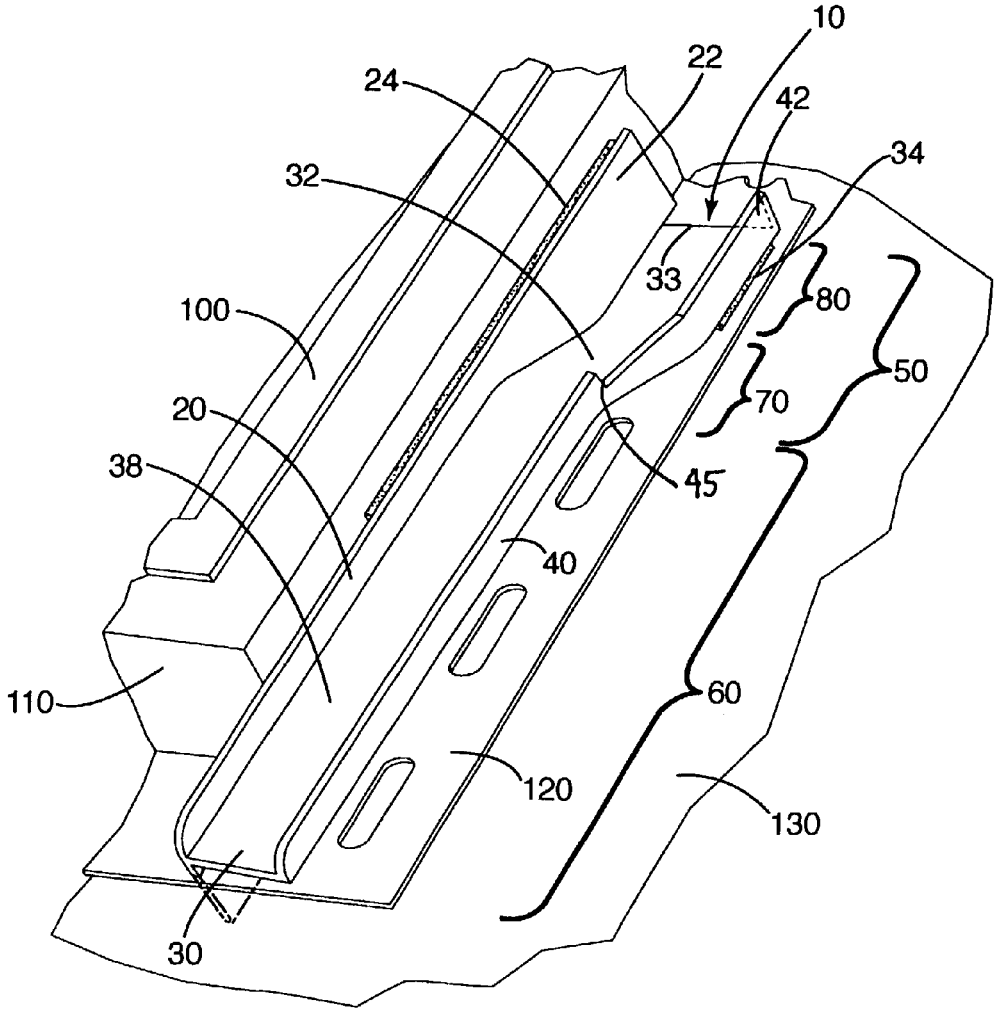
FIG. 4 is a perspective view of the water diverter.

A water diverter constructed in accordance with a first embodiment of the invention is illustrated in FIGS. 1 and 4 and generally designated 10. The water diverter includes an inner wall 20, a base 30 and an outer wall 40. The base 30 extends outwardly from the inner wall 20. The outer wall 40 extends upwardly from the base 30. In one embodiment, the outer wall 40 is substantially parallel to the inner wall 20, but may be at any angle with respect to the inner wall depending on the application. The inner wall 20 is secured to the portal structure 100. The inner wall is also referred to herein as the first wall. The outer wall is also referred to as the flange herein.

The water diverter 10 includes an upper portion 50 and a lower portion 60. In the upper portion 50, the inner wall 20, base 30 and outer wall 40 cooperate to define the collector 80. In the lower portion 60, the inner wall 20, base 30 and outer wall 40 cooperate to define a channel 38, which is in fluid communication with the collector 80.

With reference to FIGS. 1–4, the water diverter 10 is installed in a corner recess near the lower end of a portal structure 100. As used herein, a portal structure may be any window, door, opening, vent or other structure that causes a full and/or partial break in the siding 140 and/or requires the siding to be trimmed to accommodate the structure. Downstream of the transition region 70, the inner wall 20, base 30 and outer wall 40 cooperate to define a channel 38. The channel 38 is generally C- or U-shaped, but also may be of any other desired configuration. The channel 38 terminates in its lowermost portion to define an exit. The channel 38 is in fluid communication with the transition region 70 and/or the collector 80 so that water captured or collected by the collector is transferred and transported downwardly via the force of gravity through the channel 38. Accordingly, water from under the siding flows from adjacent the building structure 13, or the flange 120, or the base of j-channel (not shown) downwardly, and substantially parallel to the portal structure frame 110 under the force of gravity. In a lower portion (and/or the upper portion if desired) as shown in broken lines in FIG. 4, the inner wall 20 may extend downwardly past the base 30 so that it provides a reference abutment against the lower flange 120, the siding 140 or the building structure 130 to facilitate positioning of the device within the corner of the portal structure. As shown, the upper portion 50, and preferably the collector 80, is positioned under the siding 140. The lower portion 60, and preferably the channel 38, is positioned exterior to or on top of the siding 140. The siding 140 may be trimmed to secure the diverter to the flange 120, or underlying substructure 130, or j-channel (not shown) when installed.

In operation, the diverter 10 captures water W flowing behind the siding 140 with the collector 80. The water flows from the collector, downwardly along the portal structure 100 and into the channel 38. In so doing, the water is transitioned outward and away from the substructure 130. The water continues to flow downwardly in the channel 38 until it exits the channel on the exterior of the siding. By collecting and channeling the water from under the siding, the water diverter minimizes, and in most cases eliminates, the opportunity for water to damage the substructure 130 or otherwise leak into the building around the portal structure 100.

II. First Embodiment

With further reference to FIGS. 1 and 4, the construction of the embodiment as shown will now be described in more detail. The water diverter of the present invention is generally comprised of an upper portion 50 and a lower portion 60. In the upper portion, the inner wall 20, base 30 and outer wall 40 cooperate to define the collector 80. The collector may be of a uniform or tapered structure, that is, the outer wall 40 may or may not diverge away from the inner wall 20. Optionally, both the inner 20 and outer wall 40 may diverge toward or away from one another in the collector, depending on the application. In the upper portion, the outer wall may have a lesser profile, i.e., height, than the outer wall 42 so that the outer wall 42 in the upper portion 50 fits under a piece of siding. The walls, however, may be of the same height if desired. Further optionally, the base 30 in the upper portion 80 may define a recess 33 that channels water into the collector 80. In one embodiment, the recess 33, which may be angled or curved, prevents water from damming against the otherwise flat uppermost portion of the base 30 and the collector 80.

Downstream of the collector 80 is a transition region 70, which although shown as a part of the upper portion 50, may be part of in the lower portion 60 of the device 10. Indeed, the transition area need not be clearly defined or specifically positioned in either the upper portion or the lower portion of the diverter. As shown in FIG. 4, the base 30 in the transition region is ramped or curved away from the flange 120 or building substructure 130. This configuration offers a transition from the planar region of the collector 80 to the planar region of the channel 38, which is further away from the substructure 130 than the collector 80. In the transition region 70, the inner and outer walls may be contoured to follow the ramp or the curve of the base region. As shown in the embodiments, the base and the transition area is ramped or angled in an amount sufficient to transition water flowing along the base 30 and the collector outwardly a pre-selected amount to the base in the lower portion 60. In the embodiment shown in FIGS. 1–4, the transition region 70 offers a transition from the base 30 in the collector 80 to the base 30 in the channel 38. As shown, the transition is a distance that is substantially equal to the depth of the siding 140 over which the channel in the lower portion is disposed over. The inner and outer walls in the lowermost portion of the channel 38 may be trimmed to provide a desired appearance near the exit end of the channel 38. And optionally, a cut out 45 is defined in the outer wall to provide a reference for abutting a piece of siding against the water diverter and over the collector 80.

The water diverter of the present invention is secured to or incorporated into the portal structure 100. As shown in FIGS. 1 and 4, the base 30 in collector 80, or more generally the upper portion 50, is secured with a pressure-sensitive adhesive 34 to the nailing flange. The inner wall 22 is further secured with another pressure-sensitive adhesive 24 to the frame 110 of the portal structure 100. In one embodiment, the pressure-sensitive adhesives 24 and 34 include a removable release liner so that an installer may remove the release liner and secure the water diverter in a pre-selected position along the portal structure to insure an aesthetically appealing and/or functional position of the device relative to the portal structure 100. Optionally, the pressure-sensitive adhesives 24 and 34 may be substituted with other adhesives, or other fasteners, for examples, screws, nails, staples and the like, to secure a desired portion of the water diverter 10 to the nailing flange and/or the portal structure 100. Further optionally, the diverter 10 may be secured to the underlying substructure where the portal structure does not include a nailing flange, or to the nailing the flange of siding j-channel (not shown) where the water diverter is disposed within siding j-channel adjacent the portal structure 100.

The water diverter of the present invention may be constructed of the same material as the siding with which it is used, for example, polyvinyl chloride, however, the water diverter may also be constructed of other materials, for example, aluminum, metal or other polymers as desired.

II. Installation

Figure 5:
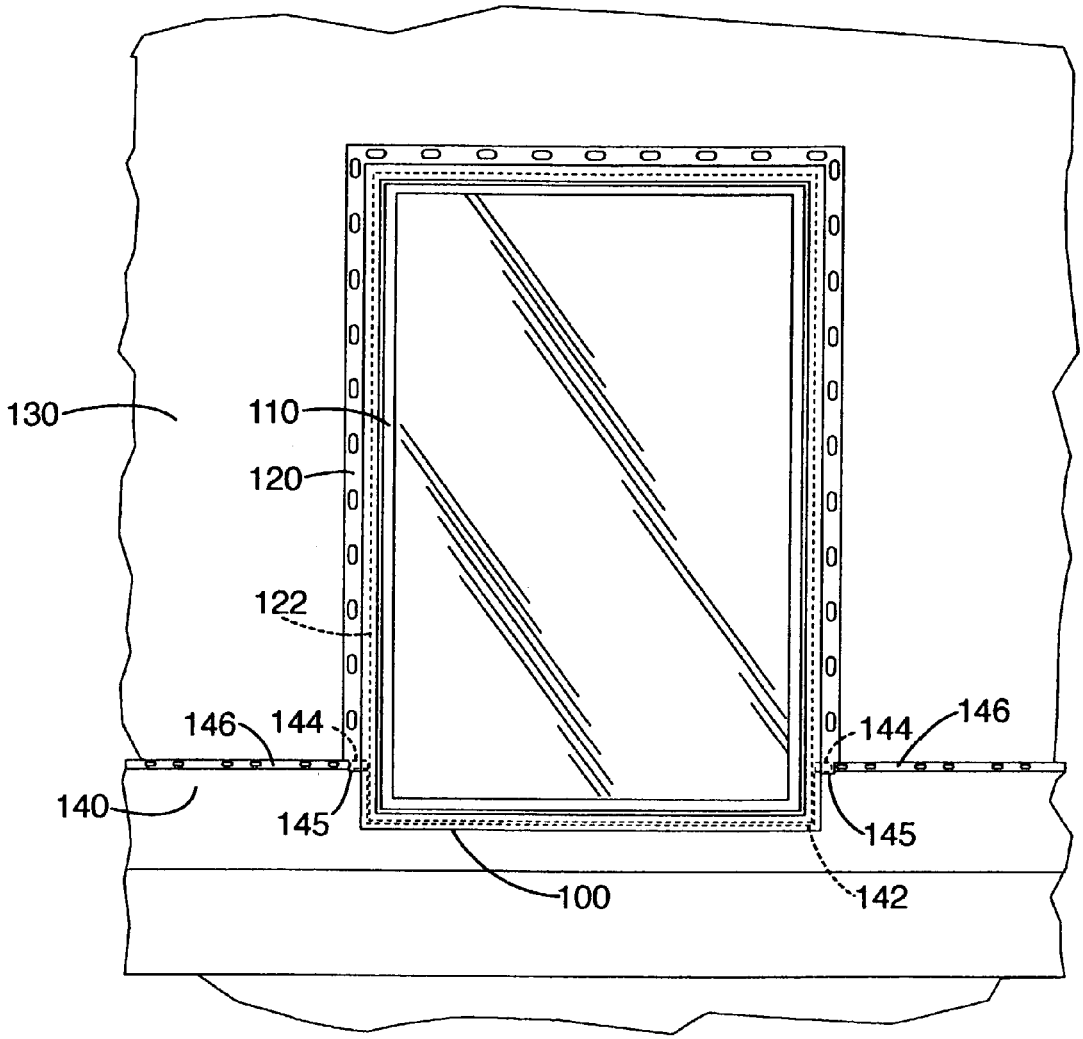
FIG. 5 is a front elevational view of a window before installing the water diverter.
Figure 6:
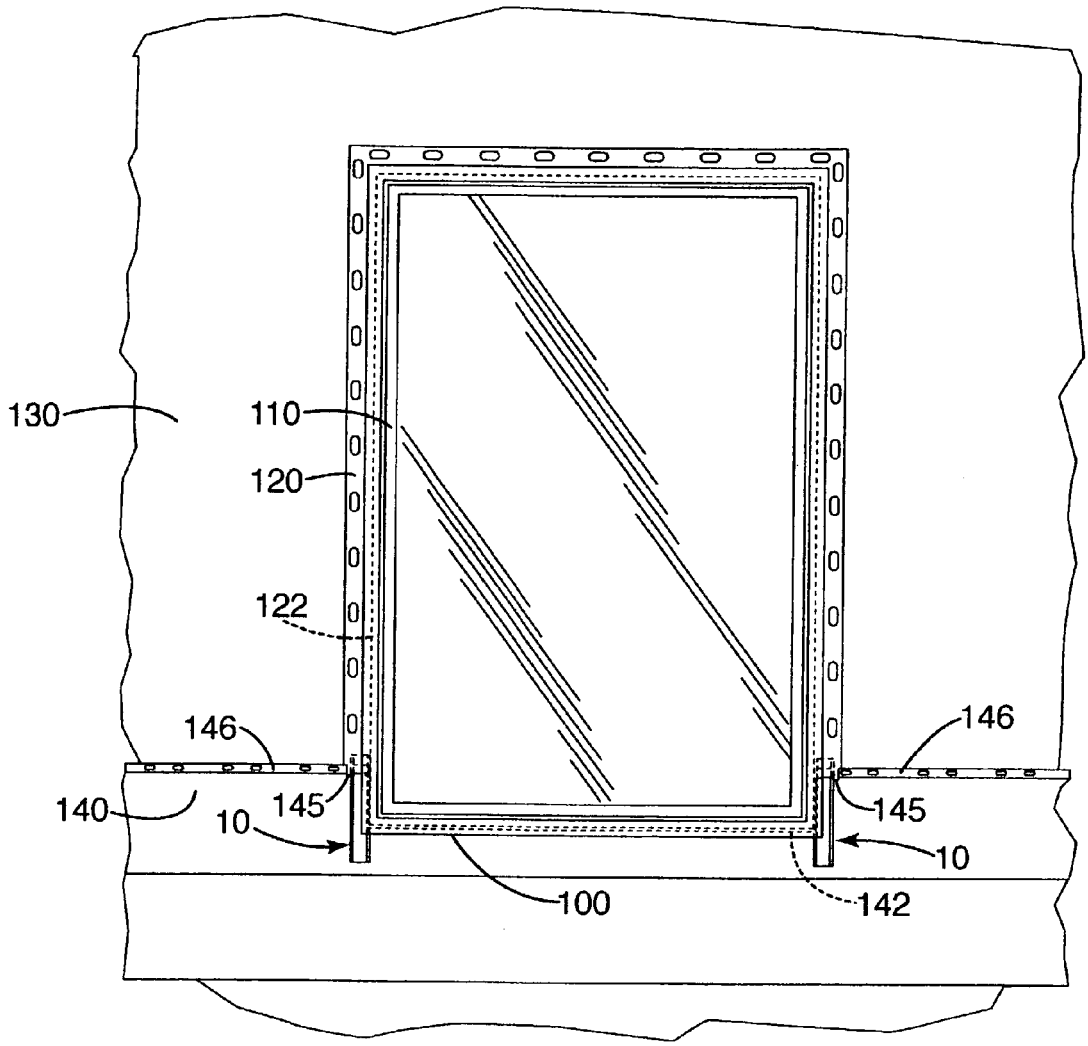
FIG. 6 is a front elevational view of a window with water diverters installed.
Figure 7:
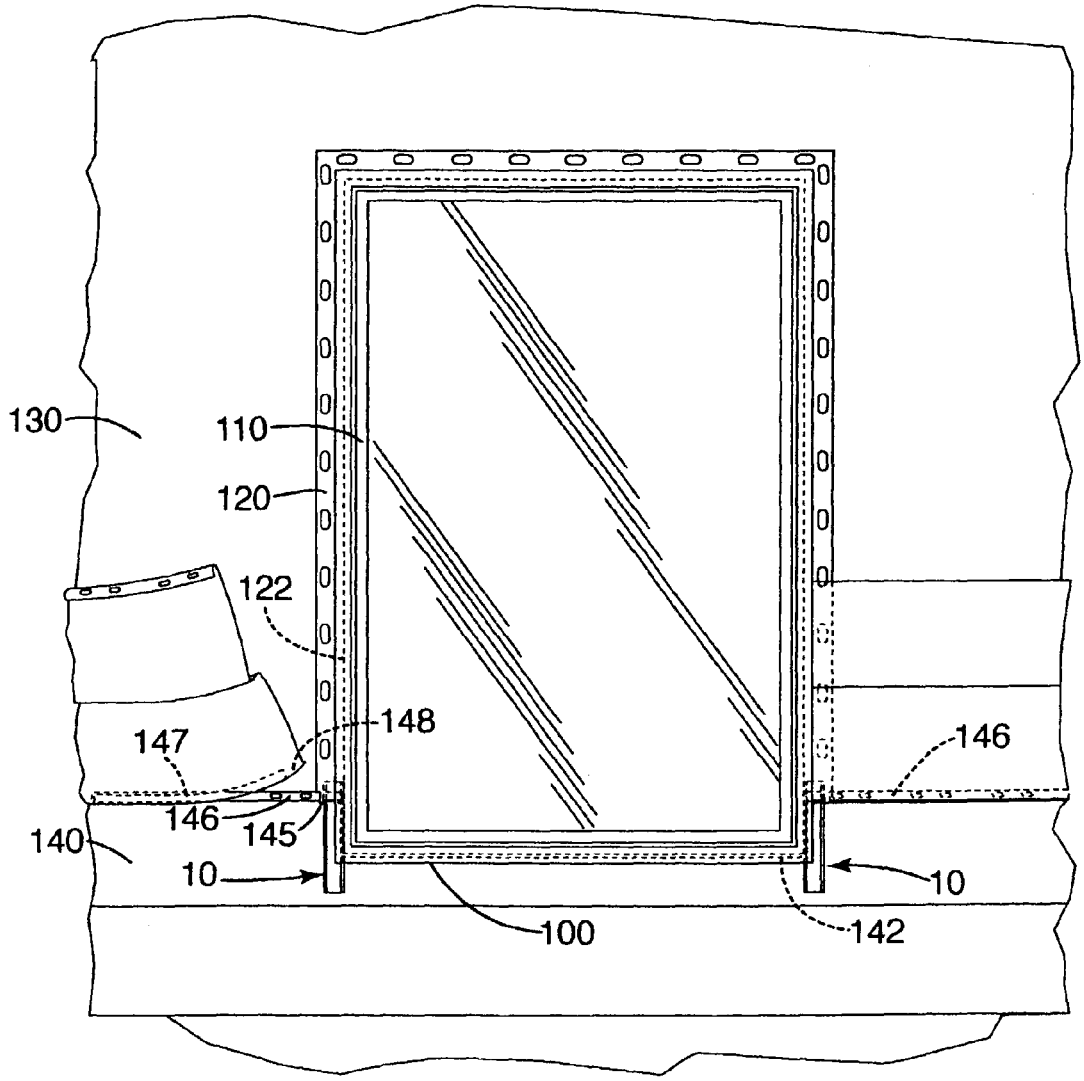
FIG. 7 is a front elevational of the view of the window with the water diverter installed and siding being installed over the water diverters.

With reference to FIGS. 5–7, installation of the water diverter 10 of the present invention will now be described. As shown in FIG. 5, siding 140 is cut along line 142 so that it fits within a channel structure 122 defined by the portal structure 100, which is shown as a window. Optionally, where a siding j-channel (not shown) is installed adjacent the portal structure 100, the siding is cut to fit within the j-channel. The siding locks 146 on opposite sides of the portal structure are cut to remove pieces 144, which are about one inch long, or another dimension that is approximately the same dimension as the width of the water diverter used in the application. The siding locks 146 as shown are positioned on the upper portion of the siding piece, and are commonly referred to as "upper locks" of the siding piece.

As shown in FIG. 6, water diverters 10 are positioned on opposite sides of the portal structure 100 adjacent the lower portion of the structure. And although shown with only one water diverter installed along opposite sides of the portal structure 100, multiple water diverters may be disposed along those opposite sides as desired. Preferably, the water diverter 10 is attached to the frame 110 and/or the flange 120 with a conventional fastening means, for example, adhesive, screws, nails and other fasteners. The installer ensures that the base 30 and/or inner wall 20 are securely fastened to the portal structure 100 or underlying substructure 130 so water does not leak behind, beside or under the water diverter. Where pressure-sensitive adhesive strips are used to secure the water diverter 10 to the portal structure 100 and/or the substructure 130, the installer ensures that there are no gaps to prevent deterioration of the adhesives or prevent water from leaking behind the siding. The water diverters 10 may be trimmed to fit so that they break evenly over the laps in the siding or to present any other desired appearance.

As shown in FIG. 7, with the water diverters 10 installed, the next higher siding panels are installed. As best shown on the left-hand side of FIG. 7, the lower lock 147 of the next installed siding is trimmed to remove lock portion, thereby defining a recess 148. When this siding piece is completely installed over the water diverter 10, the water diverter may fit within the lock recess. Optionally, some of the lower portion of the water diverter 10 fits within the recess 148. With the water diverter 10 successfully installed, additional siding is applied to cover the desired portion of the substructure 130.

III. Operation

Figure 2:
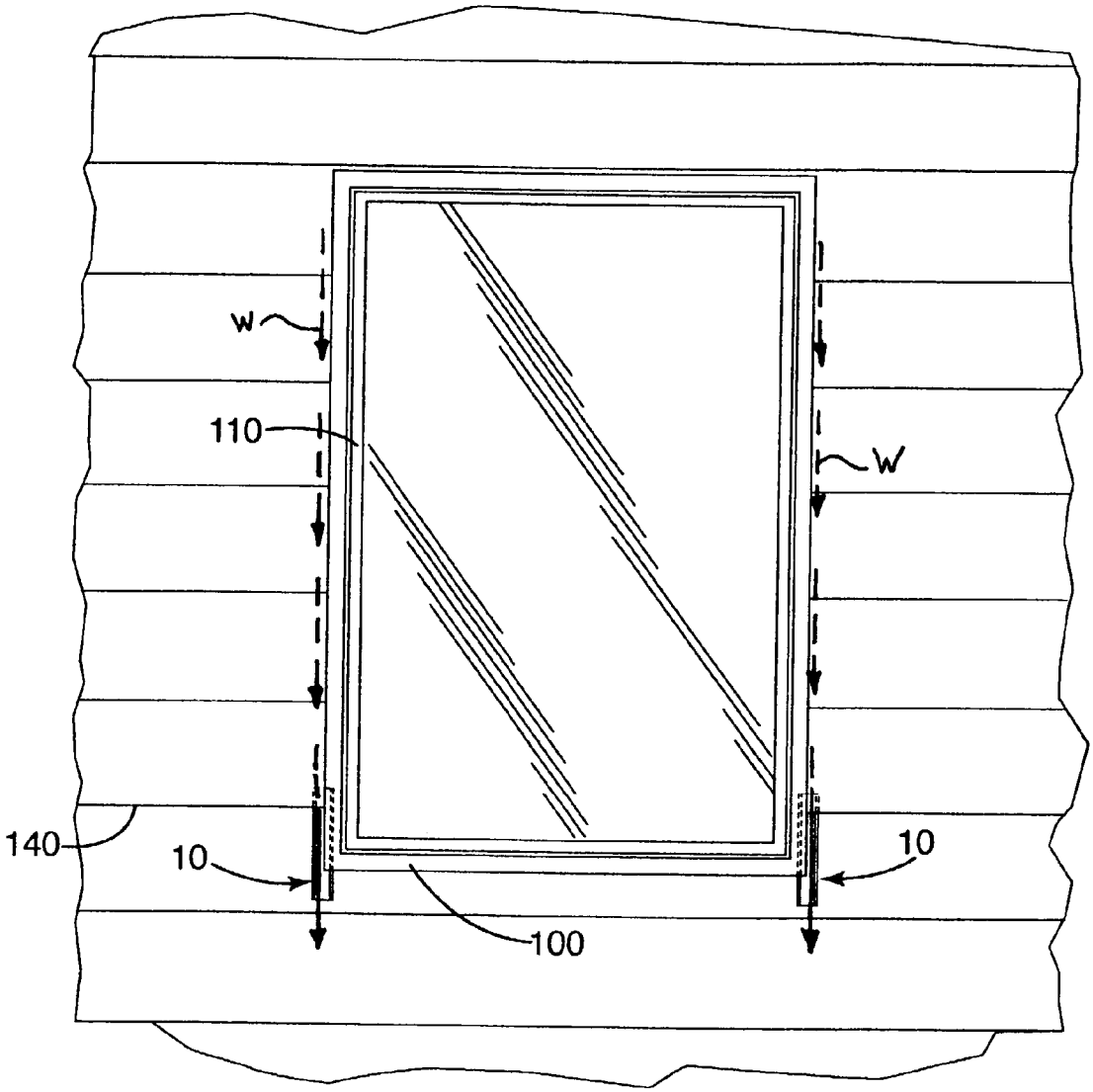
FIG. 2 is a front elevational view of the water diverter in operation.
Figure 3:
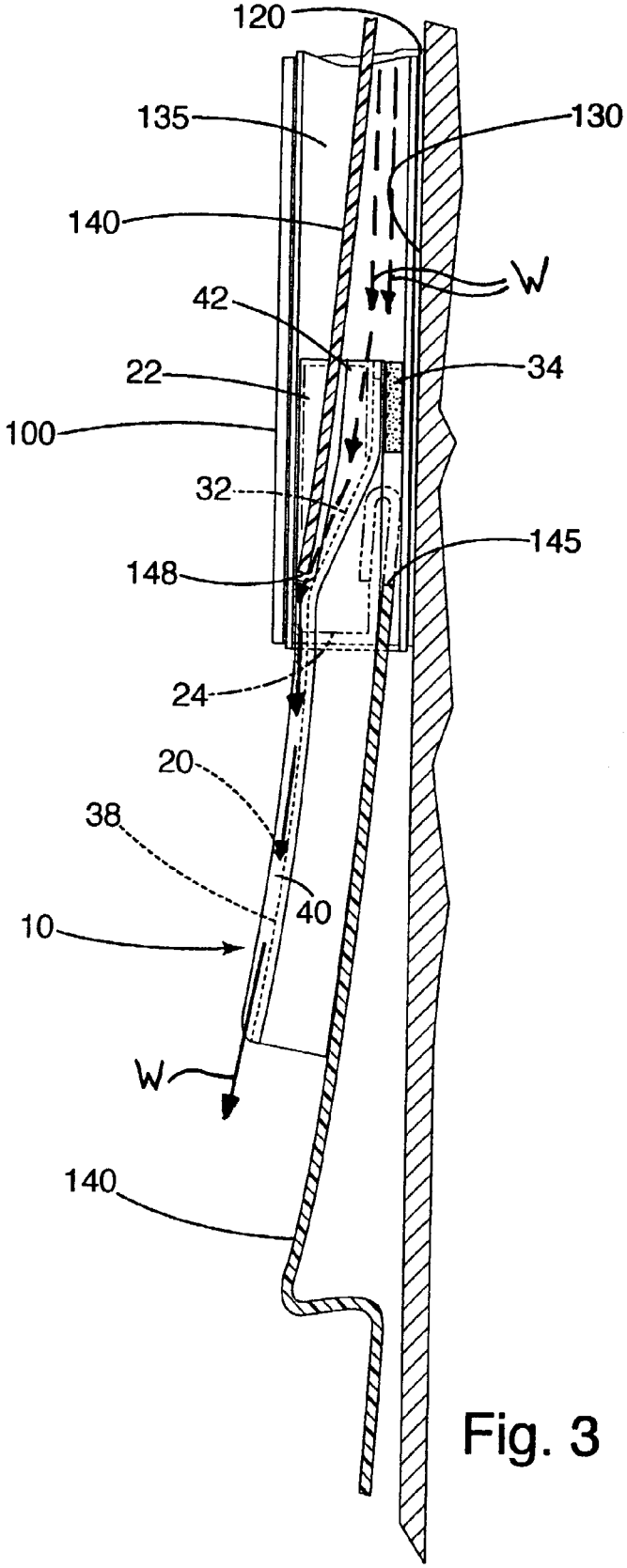
FIG. 3 is a side elevational view of the water diverter in operation.

The operation of the water diverter of the present invention will be described with more detail referring to FIGS. 2–3. Water draining down the sides of the portal structure 100 encounters the water diverter 10 upon reaching a lower region of the portal structure. The water enters the collector 80 of the water diverter and travels downwardly under the force of gravity within the collector. The water then encounters the ramped or curved portion 32 of the base and is transitioned outwardly, away from the building substructure 130 and/or the flange 120 of the portal structure. The water continues to flow downward, generally parallel to the portal structure, entering the channel 38. The channel 38 conveys the water downwardly along the device 10 and the portal structure 100 to exit into the environment under the force of gravity.

IV. Alternative Embodiments

Figure 8:
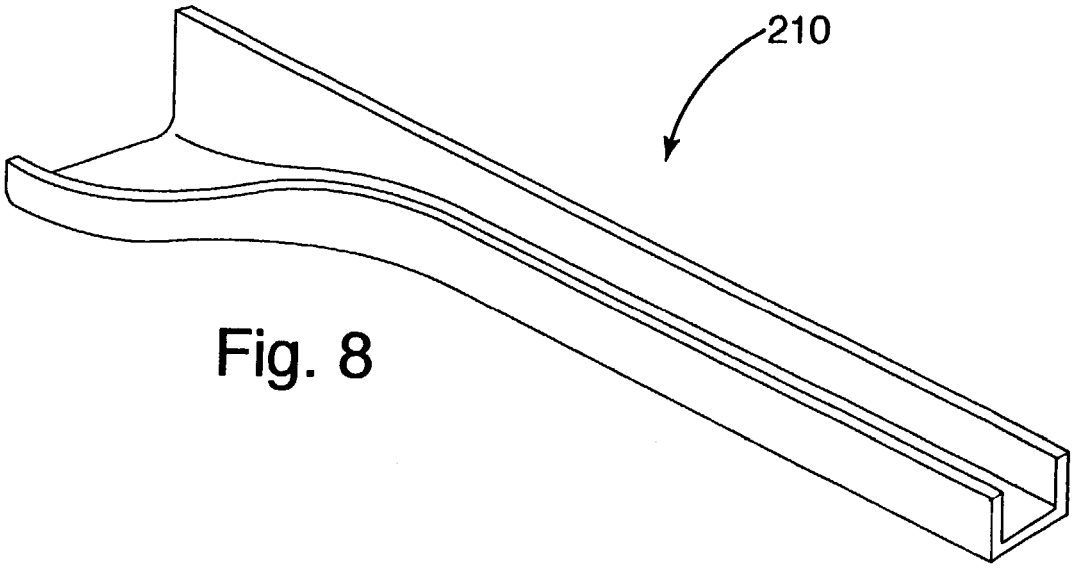
FIG. 8 is a perspective view of a first alternative embodiment of the water diverter.
Figure 9:
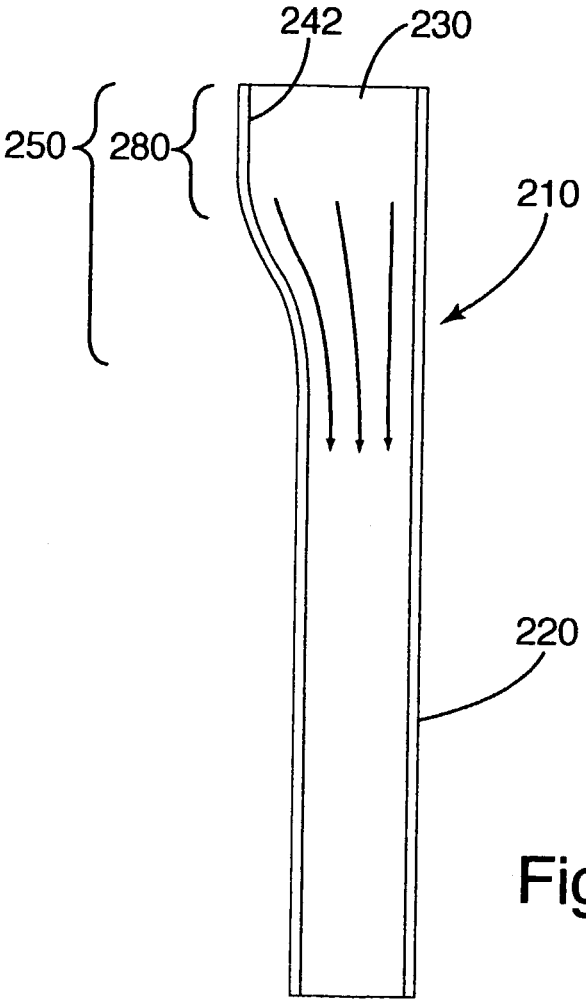
FIG. 9 is a top plan view of the first alternative embodiment of the water diverter.

A first alternative embodiment 210 of the water diverter is illustrated in FIGS. 8 and 9. This embodiment is substantially identical to the previously described embodiment except that in the upper portion 250, the collector 280 flares outward. Specifically, the outer wall 242 diverges or curves away from the inner wall 220 to form a wider collector, and thereby collect more water. The base 230 in this region is also wider. Although not shown, this diverter 210 may include fasteners as described above.

Figure 10:
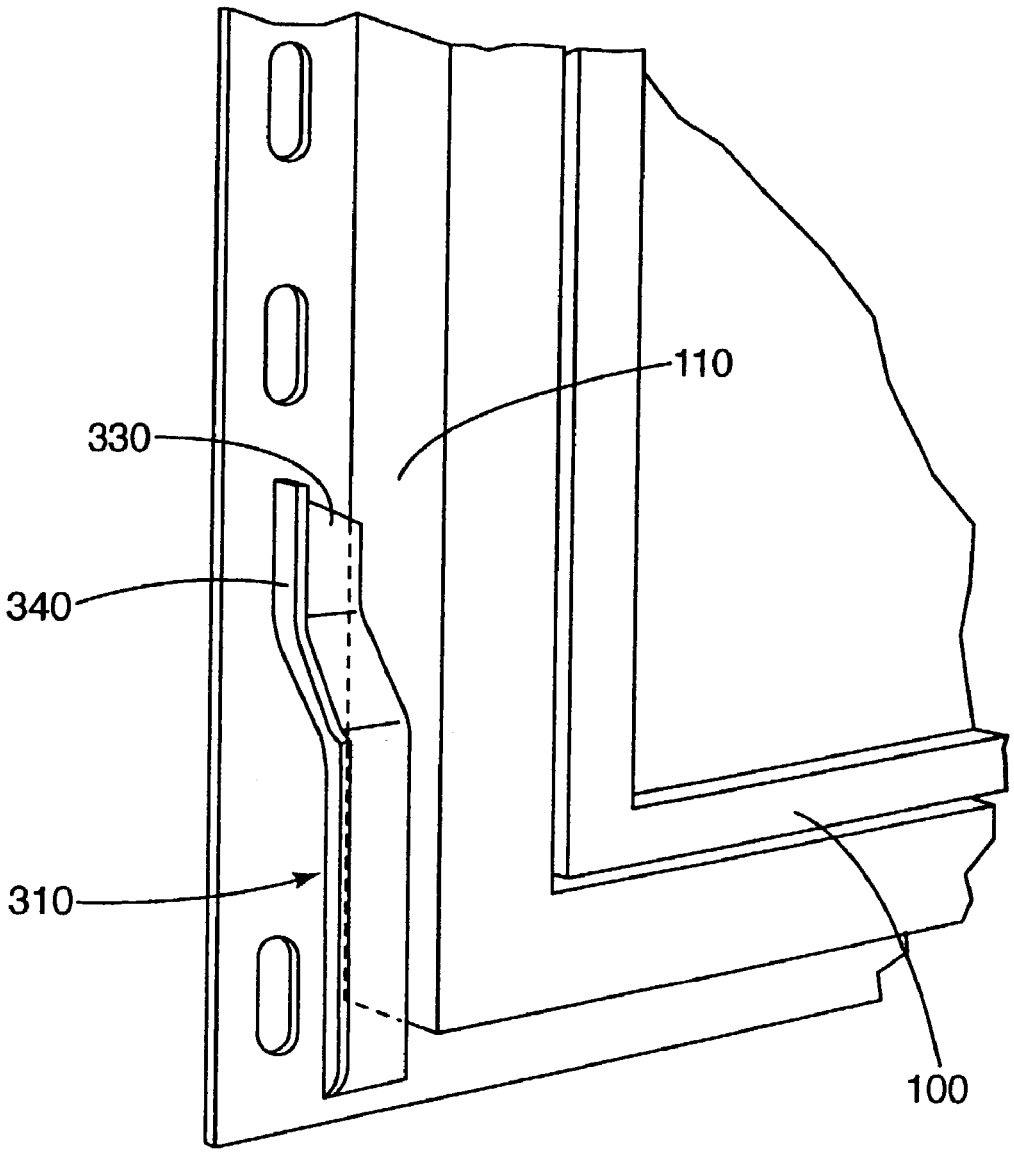
FIG. 10 is a perspective view of a second alternative embodiment of the water diverter.

A second alternative embodiment 310 of the water diverter is illustrated in FIG. 10. As with the previous embodiments, the diverter 310 includes a base 330 and an outer wall 340. However, the inner wall of the water diverter 310 is formed by the frame member 110 of the portal structure 100. In effect, the water diverter 310 forms an integral part of the portal structure 100. The portion of the channel extending downwardly past the lowermost portion of the portal structure 100 may be trimmed to fit and break over the siding when installed. As with the immediately preceding embodiment, the upper portion of the water diverter 310 may be flared as desired.

Figure 11:
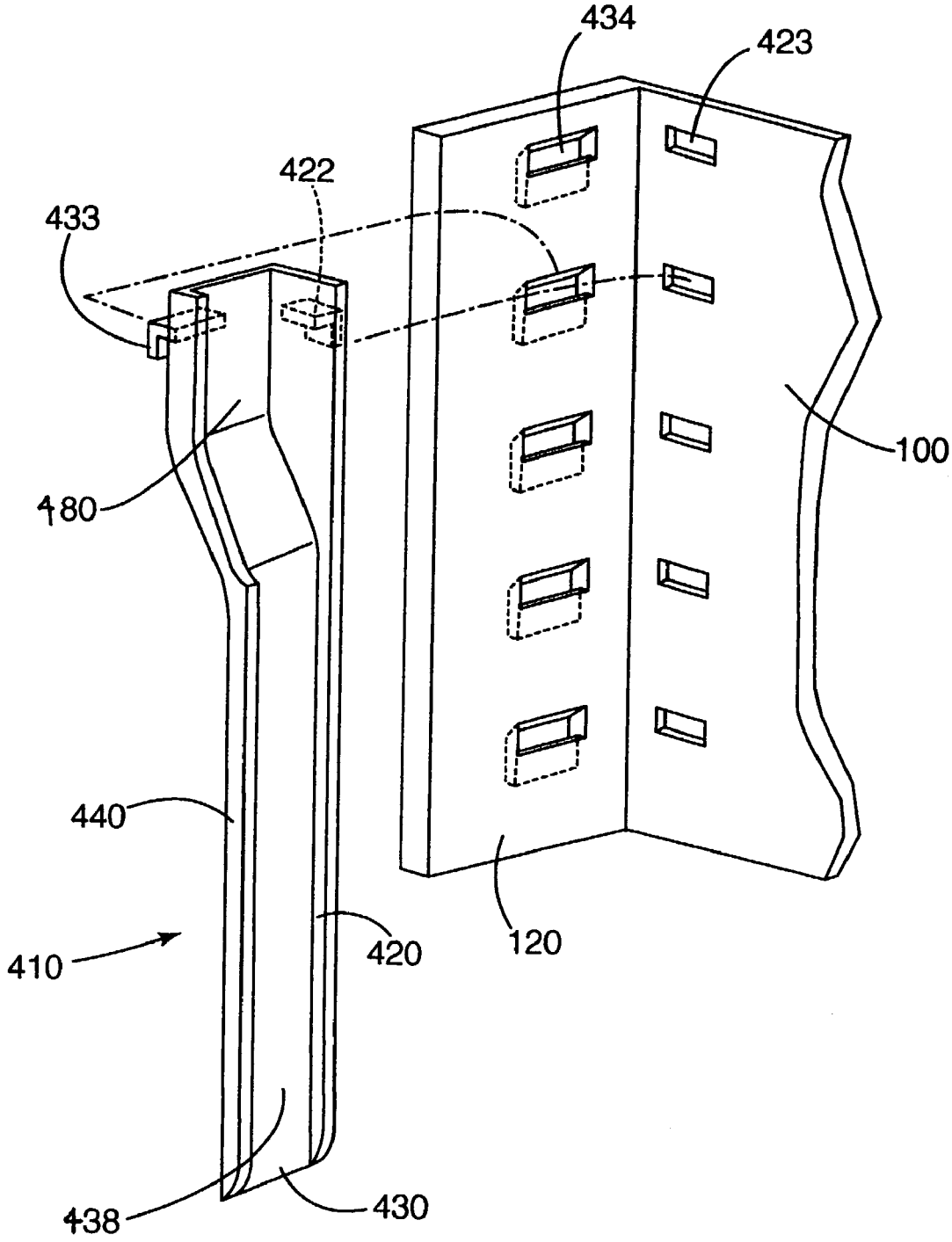
FIG. 11 is an exploded perspective view of a third alternative embodiment of the water diverter.

A third alternative embodiment 410 of the water diverter is illustrated in FIG. 11. As with the previous embodiment, the water diverter includes an inner wall 420, a base 430 and an outer wall 440 that cooperate to define a collector 48 and a channel 43 in the upper and lower regions, respectively. However, the water diverter 410 includes locking features, which as shown is a tab 422 disposed on the inner wall 420. This tab generally includes a flange that fits within a recess 423 defined by the portal structure 100 to lock the water diverter in place in the corner of the portal structure 100. Further optionally, the portal structure 100 may define a plurality of recesses 423 so that the water diverter may be selectively installed and locked in relation to the portal structure 100 in any desired location. Optionally, the water diverter may also or alternatively include a base locking tab 430 that interlocks with the corresponding alternative and/or additional recesses 434 defined in the flange 120 or substructure (not shown) to further or alternatively lock the water diverter in the corner recess of the portal structure 100. Other locking features may be substituted for those shown in FIG. 11.

The above descriptions are those of the preferred embodiments of the invention. Various alterations and changes can be made without departing from the spirit and broader aspects of the invention as defined in the appended claims, which are to be interpreted in accordance with the principles of patent law including the doctrine of equivalents. Any references to claim elements in the singular, for example, using the articles "a," "an," "the," or "said," is not to be construed as limiting the element to the singular.

The embodiment of the invention in which an exclusive property or privilege is claimed are defined as follows:

1. A water diverter system for channeling a water flow out from under siding, the water diverter system comprising:

a portal structure including an exterior and a frame;

an inner wall joined with the frame;

a base joined with said inner wall, at least a portion of the base positioned between the siding and a building wall, another portion of the base projecting out from under the siding; and an outer wall joined with the base and extending upwardly, wherein the inner wall, the base and the outer wall cooperate to define a collector that collects the water flow along at least one of the building wall and the exterior of the portal structure in an upper portion of the water diverter, wherein the inner wall, the base and the outer wall cooperate to define a channel in fluid communication with the collector in a lower portion of the water diverter, said channel diverting the water flow downwardly along the exterior of the frame, wherein the inner wall, the base and the outer wall cooperate to define a transition region that transitions the water flowing in the collector outwardly away from the at least one of the building wall and the exterior of the portal structure and into the channel, and wherein the collector, channel and transition region are located only on the exterior of the portal structure.

2. The water diverter system of claim 1 wherein the collector is of a first width and the channel is of a second width, wherein the first width is substantially equal to the second width.

3. The water diverter system of claim 1 wherein the collector is of a first width and the channel is of a second width, the first width greater than the second width.

4. The water diverter system of claim 1 wherein the transition region is configured in at least one of a curved or angled shape.

5. The water diverter system of claim 1 wherein the base defines a recess in the upper portion that funnels the water flow into the collector.

6. The water diverter system of claim 1 wherein the inner wall forms a portion of the frame.

7. The water diverter system of claim 1 comprising means for securing at least one of the inner wall to the frame and the base to the building wall.

8. The water diverter system of claim 1 wherein the inner wall has a first profile and the outer wall has a second profile, the second profile less than the first profile.

9. A system for diverting a water flow out from under siding and away from a building substructure comprising:

a vertical portal structure including an exterior;

a first wall;

a base extending outwardly from said first wall, said base being configured in at least one of a first configuration that is angled outwardly away from the building substructure and a second configuration that is curved outwardly away from the building substructure, a portion of said base being positioned between the siding and the building substructure, another portion of the base extending beyond the siding; and a flange extending outwardly from the base substantially parallel to the first wall, said first wall, base and flange cooperating to define a channel extending along the exterior of the vertical portal structure, whereby the channel diverts the water flow downwardly along the exterior of the vertical portal structure and away from the building substructure, wherein the first wall and the base are joined only with the exterior of the vertical portal structure.

10. The system of claim 9 wherein the first wall is a portal structure wall.

11. The system of claim 9 wherein the first wall includes an adhesive to secure the wall to the portal structure.

12. The system of claim 9 wherein the first wall includes a tab and the portal structure includes a corresponding recess to receive the tab and secure the first wall to the portal structure.

13. The system of claim 9 wherein the base includes a first side and a second side, the first side including an adhesive to secure the base to at least one of the portal structure and the building substructure.

14. The system of claim 9 wherein the base defines a recess to funnel the water flow into the channel.

15. The system of claim 9 comprising an upper portion and a lower portion, the wall is of a first height, the flange is of a second height.

16. The system of claim 15 wherein in the upper portion, the first height is greater than the second height.

17. The system of claim 15 wherein in the lower portion, the first height is substantially equal to the second height.

18. A water diverter system for diverting a water flow away from a building wall from under siding comprising:

a portal structure including an exterior;

an upper portion defining a collector;

a lower portion in fluid communication with the upper portion, said lower portion defining a channel that channels the water flow substantially downwardly along a path under gravity; and a transition portion between the upper portion and the lower portion in fluid communication with both the upper portion and the lower portion, wherein at least one of the upper portion, transition portion, and lower portion is configured in at least one of a tapered shape and a curved shape to divert the water flow away from the building wall and into the channel whereby the water flow is pulled downwardly by gravity within the channel, wherein a part of at least one of the upper portion, the lower portion and the transition portion is concealed from view under the siding, and wherein another part of at least one of the upper portion, the lower portion and the transition portion projects out from under the siding, wherein at least part of each of the upper portion, lower portion and transition portion are positioned on the exterior of the portal structure.

19. The water diverter system of claim 18 wherein the collector includes a first wall adjacent the portal structure, a base and a second wall, the second wall substantially parallel to the first wall.

20. The water diverter system of claim 19 wherein the first wall is of a first height and the second wall is of a second height, the second height less than the first height.

21. A method for installing siding comprising:

trimming a first piece of siding including an upper lock to fit around a portal structure;

trimming a portion of the upper lock adjacent the portal structure to define a lock recess;

providing a water diverter including an inner wall, a base projecting outwardly from the inner wall and an outer wall joined with the base, whereby said inner wall, base and outer wall cooperate to define a collector and a channel;

securing the water diverter to the portal structure so that at least a portion of the collector is disposed in at least one of a first position above the lock recess and a second position at least partially within the lock recess, and so that at least a portion of the channel is disposed below the lock recess, exterior to the first piece of siding;

providing a second piece of siding including a lower lock;

trimming the lower lock to define a lower lock recess; and interlocking the lower lock and the upper lock to secure the first piece of siding to the second piece of siding, whereby at least a portion of the collector is disposed under the second piece of siding.

* * * * *